US005525044A

United States Patent [19]

Chen

[11] Patent Number: 5,525,044

[45] Date of Patent: Jun. 11, 1996

[54] HIGH PRESSURE GAS COMPRESSOR

[75] Inventor: Tze-Ning Chen, Sudbury, Mass.

[73] Assignee: Thermo Power Corporation, Waltham, Mass.

[21] Appl. No.: 429,723

[22] Filed: Apr. 27, 1995

[51] Int. Cl.[6] ..... F09B 25/02

[52] U.S. Cl. ..... 417/262; 417/266

[58] Field of Search ..... 417/255, 261, 417/262, 266

[56] References Cited

U.S. PATENT DOCUMENTS

| | | | |
|---|---|---|---|
| Re. 13,645 | 11/1913 | Stone . | |
| 433,483 | 6/1982 | Gozzi | 417/266 |
| 745,298 | 11/1903 | Sergeant et al . | |
| 816,520 | 3/1906 | Wray | 417/262 |
| 1,184,447 | 5/1916 | Hammond | 417/266 |
| 2,178,310 | 10/1939 | Pescara | 230/56 |
| 2,180,158 | 11/1939 | McCoy et al. | 417/261 |
| 2,241,957 | 5/1941 | Pescara | 230/56 |
| 2,357,029 | 8/1944 | Smith | 417/261 |
| 2,387,603 | 10/1945 | Neugebauer et al. | 417/266 |
| 4,149,831 | 4/1979 | Davis | 417/251 |
| 4,334,833 | 6/1982 | Gozzi | 417/258 |
| 4,345,880 | 8/1982 | Zanarini | 417/264 |
| 4,627,795 | 12/1986 | Schmitz-Montz | 417/267 |
| 4,705,460 | 11/1987 | Braun | 417/266 |
| 4,784,579 | 11/1988 | Gazzera | 417/266 |
| 4,832,578 | 5/1989 | Putt | 417/251 |

*Primary Examiner* Richard A. Bertsch
*Assistant Examiner* William J. Wicker
*Attorney, Agent, or Firm* Pandiscio & Pandiscio

[57] ABSTRACT

There is presented a gas compressor including a housing defining adjacent first and second chambers in axial alignment, a rod extending through the first chamber and into the second chamber, a tubular projection extending from a first end of the housing into the second chamber, a cylindrically-shaped end portion fixed to the rod and disposed slidably upon the projection and within the second chamber, a piston fixed to the rod and slidably disposed within the first chamber, and conduits for admitting gas to the first chamber, transferring gas from one compression stage to another, and discharging compressed gas from the housing.

27 Claims, 4 Drawing Sheets

HIGH PRESSURE GAS COMPRESSOR

BACKGROUND OF THE INVENTION

1. Field of the Invention

This invention relates to gas compressors, and is directed more particularly to a relatively inexpensive high pressure gas compressor suitable for charging the tanks of vehicles operating on compressed natural gas.

2. Description of the Prior Art

Compressors currently used in compressed natural gas (CNG) fueling stations for vehicles typically provide three or four stages of compression. The cost of such compressors is high because a separate compressor cylinder and piston unit is used for each compression stage.

Because the CNG compressors now in use for fueling stations are designed for relatively quick delivery, and because in order to obtain quick delivery, the compressor must discharge relatively large quantities of gas at high pressures, the compressors are necessarily large and expensive.

Relatively simple and inexpensive units are suitable for residential or small fleet use, even though requiring a relatively long time for a vehicle tank filling. The fact that such compressors for residential use, and the like, have design features similar to those of large capacity compressors, for "fast fill" operations, the cost per unit delivery capacity of the compressor systems renders the currently used systems beyond the economic reach of residential CNG users.

Accordingly, there is a need for a high pressure natural gas compressor which is relatively inexpensive and suitable for residential or small fleet use in filling the tanks of CNG fueled vehicles.

SUMMARY OF THE INVENTION

It is, therefore, an object of the invention to provide a multi-stage high pressure gas compressor having fewer components than current gas compressors and therefore is less expensive to make and operate.

A further object of the invention is to provide such a compressor as is suitable for residential or small fleet use in filling tanks of CNG fueled vehicles.

With the above and other objects in view, as will hereinafter appear, a feature of the present invention is the provision of a gas compressor comprising a housing defining adjacent first and second cylindrical chambers in axial alignment, the second of the chambers having a smaller inside diameter than the first of the chambers. The compressor is provided with rod means extending through the first chamber and into the second chamber, and a tubular projection extending from a first end of the housing into the second chamber. A cylindrically-shaped end portion is fixed to the rod means, the end portion being disposed slidably upon the projection and within the second chamber. A piston is fixed to the rod means and is slidably disposed within the first chamber. The compressor further includes conduit means for admitting gas to the first chamber, for transferring gas from the first chamber to the second chamber and from the second chamber to the interior of the end portion, and for discharging compressed gas from the end portion through the projection.

In accordance with a further feature of the invention, there is provided a gas compressor comprising a housing having a first cylindrical chamber and a second cylindrical chamber, the first and second cylindrical chambers being disposed in tandem end-to-end, the second chamber being of lesser inside diameter than the first chamber, the second chamber having at an end thereof an inwardly-extending projection having a passageway therein extending from a closed end of the projection to the end of the second chamber. The compressor is further provided with a rod means extending through the first chamber and into the second chamber, a piston fixed to the rod means and movable in the first chamber, and a cylindrically-shaped end portion fixed to the rod means and movable in the second chamber, the cylindrically-shaped end portion being open at one end, and the projection extending into said end portion. An intake orifice is disposed in the first chamber. An orifice and first check valve are disposed in a wall separating the first chamber and the second chamber. An orifice and second check valve are disposed in a closed end of the end portion and an orifice and third check valve are disposed in the closed end of the projection. A first compression stage is formed in the first chamber between the piston and the wall, a second compression stage is formed in the second chamber between the wall and the closed end of the end portion, and a third compression stage is formed in the end portion between the closed end of the end portion and the projection closed end.

In accordance with a further feature of the invention, there is provided a gas compressor comprising a housing having a first cylindrical chamber, a second cylindrical chamber, the first and second chambers being disposed in tandem end-to-end, the second chamber being of lesser inside diameter than the first chamber, and a third cylindrical chamber comprising an extension of the second chamber, the third chamber having a greater inside diameter than the second chamber, the third chamber having at an end thereof an inwardly-extending projection having a passageway therein extending from a closed end of the projection to the end of said third chamber. The compressor is further provided with a rod extending through the first chamber and into the second chamber. A piston is fixed to the rod and is movable in the first chamber. A cylindrically-shaped end portion is fixed to the rod and is movable in the second and third chambers, the end portion being open at one end, the projection extending into the end portion, the end portion having at its open end an outwardly extending annular flange which, at the periphery thereof, engages an inside wall of the third chamber. A first intake orifice and a first intake valve are disposed in a first chamber wall on one side of the piston, and a second intake orifice and a second intake valve are disposed in the first chamber wall on another side of the piston. An orifice and first check valve are disposed in a wall separating the first chamber and the second chamber, an orifice and a second check valve are disposed in a closed end of the end portion, an orifice and a third check valve are disposed in the closed end of the projection, and a flange orifice and a flange check valve are disposed in the annular flange. A first transfer conduit extends from the first chamber on the other side of the piston to the third chamber between the annular flange and the end of the third chamber and a second transfer conduit extends from the third chamber to the projection passageway proximate the end of the third chamber. Thus, a first first-compression-stage is formed in the first chamber on the one side of the piston, a second first-compression-stage is formed in the first chamber on the other side of the piston, a first second-compression-stage is formed in the second chamber between the wall and the closed end of the end portion, a second second-compression-stage is formed in the third chamber between the annular flange and the end of the third chamber, a first third-compression-stage is formed in the end portion between the closed end of the end portion and the closed end of the projection and a second third-compression-stage is formed in the third chamber between a side wall of the end portion and the inside wall of the third chamber, and between the annular flange and an annular wall at the juncture of the second and third chambers.

In accordance with a still further feature of the invention, there is provided a gas compressor comprising a housing having therein a first cylindrically-shaped chamber defining a first compression stage, a second cylindrically-shaped chamber extending axially from the first chamber and having an inside diameter less than the inside diameter of the first chamber, the second chamber defining a second compression stage, and a cylindrically-shaped third chamber extending axially from the second chamber and having an inside diameter less than the inside diameter of the second chamber, and a cylindrically-shaped projection extending into the third chamber. The compressor is further provided with a rod extending through the first and second chambers and into the third chamber. A piston is provided having a piston first portion reciprocally disposed in the first chamber and a piston second portion of smaller diameter than the piston first portion reciprocally disposed in the second chamber, the rod passing through a wall between the second and third housing chambers. An open-ended cylindrically-shaped end portion of the rod is reciprocally disposed in the housing third chamber around the projection. A gas inlet orifice is disposed in a wall of the housing first chamber, and a gas outlet extends through the projection. A first check valve is disposed in a first passage in the piston first portion, a second check valve is disposed in a second passage extending through the piston first and second portions, a third conduit check valve is disposed in a third conduit through the wall, an end portion check valve is disposed in a conduit extending through a closed end of the end portion remote from an open end thereof, and a projection check valve is disposed in a projection conduit in a closed end of the projection remote from the housing first end. There is thus provided the first compression stage between a second end wall of the housing and a surface of the piston first portion, the second compression stage between an end wall of the piston second portion and the wall between the housing second and third chambers, a third compression stage in the third housing chamber between the wall and the end of the end portion, and a fourth compression stage in the end portion between the closed end thereof and the closed end of the projection.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
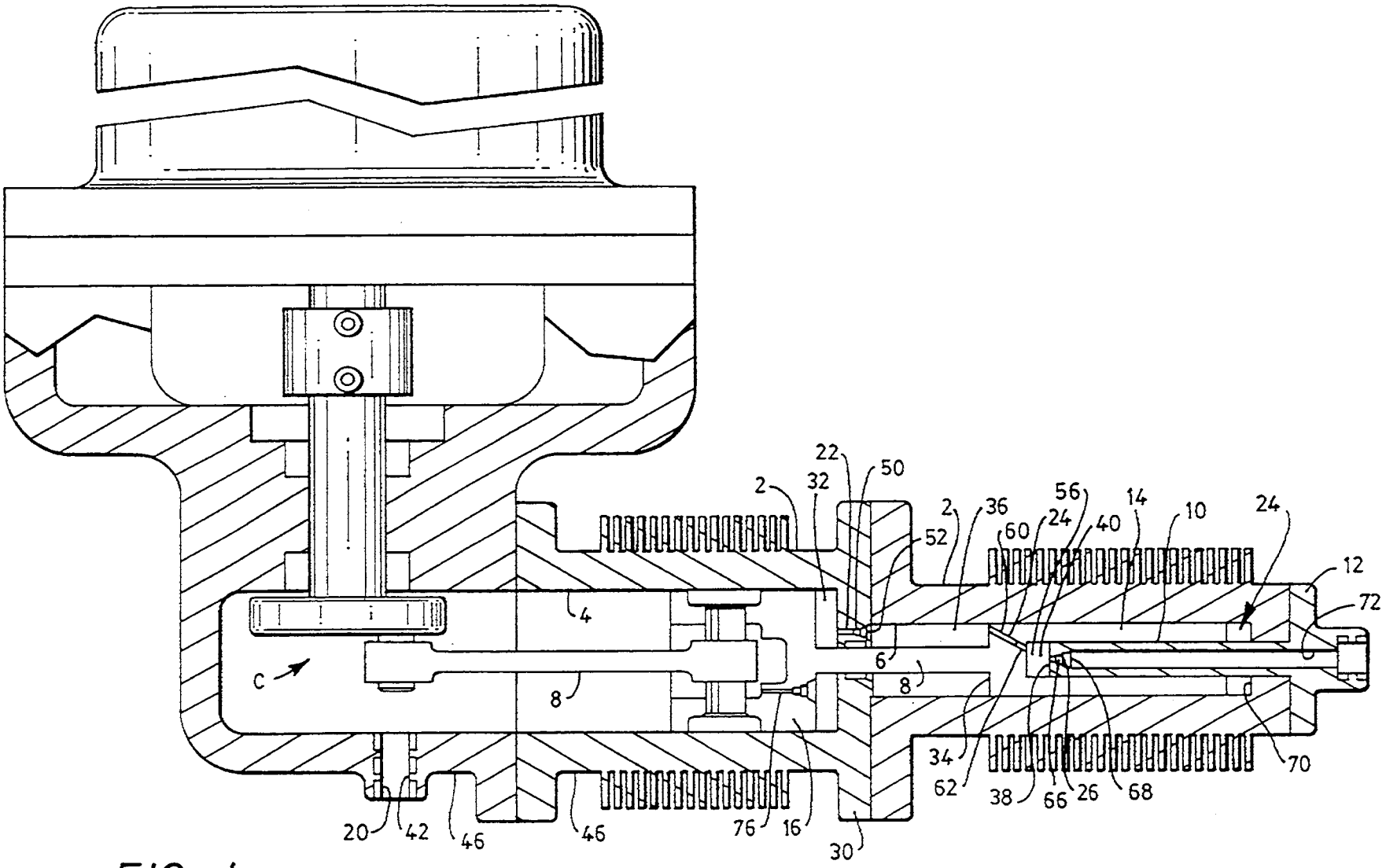
FIG. 1 is a partly sectional view of one form of compressor illustrative of an embodiment of the invention.

Referring to the drawings, it will be seen that an illustrative compressor includes a housing 2 defining first and second cylindrical chambers 4, 6 in axial alignment, the second 6 of the chambers having a smaller inside diameter than the first 4 of the chambers.

A rod means 8 extends through the first chamber 4 and into the second chamber 6. A tubular projection 10 extends from a first end 12 of the housing 2 and into the second chamber 6. A cylindrically-shaped end portion 14 is fixed to the rod means 8 and is disposed slidably upon the projection 10 and within the second chamber 6. A piston 16 is fixed to the rod means 8 and is slidably disposed within the first chamber 4.

Conduit means 20 are provided for admitting gas to the first chamber 4. Further conduit means 22, 24 are provided, respectively, for transferring gas from the first chamber 4 to the second chamber 6, and from the second chamber 6 to the interior of the end portion 14. Still further conduit means 26 are provided for discharging compressed gas from the end portion 14 and through the projection 10.

The piston 16 and a wall 30 separating the first chamber 4 from the second chamber 6 define a first compression stage 32 in the first chamber 4. The wall 30 and a closed end 34 of the end portion 14 define a second compression stage 36 in the second chamber 6. The closed end 34 of the end portion 14 and a closed end 38 of the projection 10 define a third compression stage 40.

The conduit means 20 for admitting gas to the first chamber 4 comprises an orifice 42 in a wall 46 of the first chamber 4. In the embodiment shown in FIG. 1, the intake orifice 42 is located near the crankshaft C of an engine driving the rod means 8. In the embodiments shown in FIGS. 2–4, the rod means 8 passes through a housing second end wall 172, and the intake orifice 42 is located proximate the wall 30 separating the first chamber 4 from the second chamber 6, and an intake valve 44 is disposed in the orifice 42. The conduit means 22 for transferring gas from the first chamber 4 to the second chamber 6 comprises an orifice 50 in the wall 30 and a first check valve 52 disposed in the orifice 50. The conduit means 24 for transferring gas from the second chamber 6 to the interior 56 of the end portion 14 comprises an end portion orifice 60 in the closed end 34 of the end portion 14, and an end portion check valve 62 disposed in the orifice 60. The conduit means 26 for discharging gas from the third compression stage 40, through the tubular projection 10, comprises a projection orifice 66 in the closed end 38 of the projection 10, and a projection check valve 68 disposed in the orifice 66. The tubular projection 10 is open to the housing first end 12.

Figure 2:
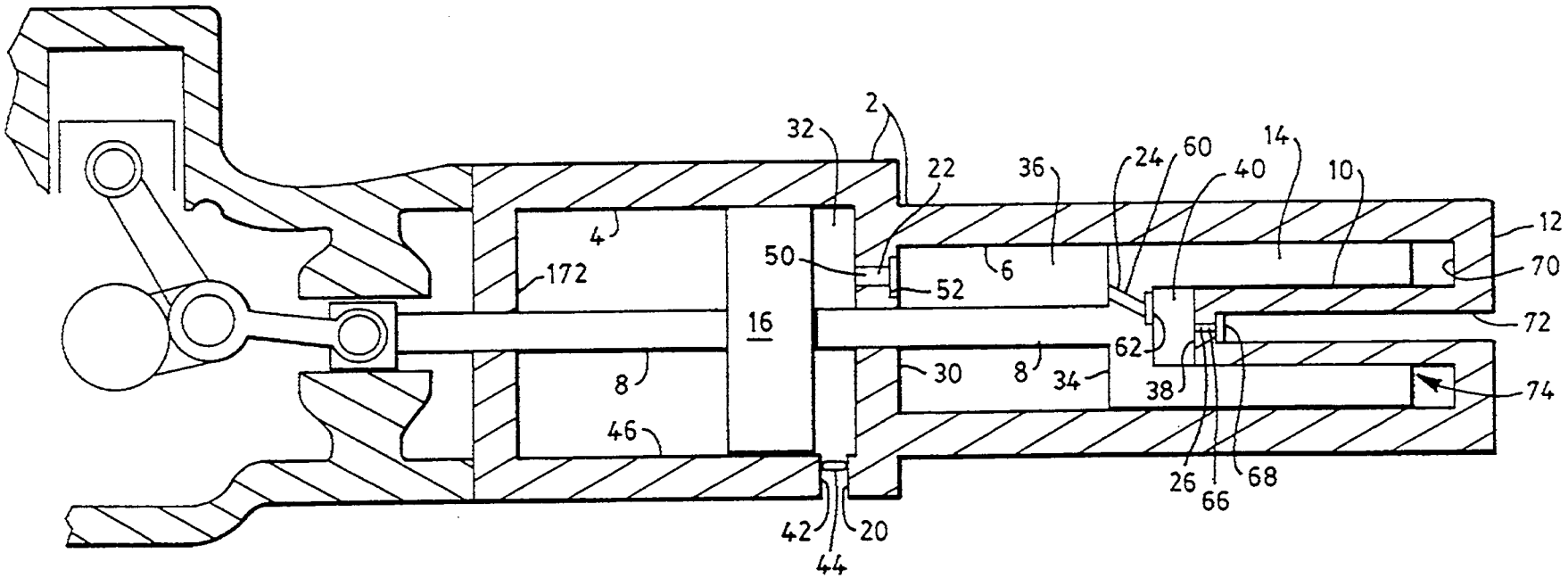
FIG. 2 is a diagrammatic illustration of an alternative embodiment of the inventive compressor.

In the embodiments shown in FIGS. 1 and 2, the housing 2 defines the first and second cylindrical chambers 4, 6 which are disposed in tandem end-to-end. The second chamber 6 is of lesser inside diameter than the first chamber 4. At an end 70 of the second chamber 6 there is the inwardly-extending tubular projection 10, having a passageway 72 therein extending from the closed end 38 of the projection 10 to the end 70 of the second chamber 6, which coincides with the housing first end 12. The rod means 8 extends through the first chamber 4 and into the second chamber 6. The piston 16 is fixed to the rod means 8 and is movable in the first chamber 4.

The cylindrically-shaped end portion 14 is fixed to the rod means 8 and is movable in the second chamber 6. The end portion 14 is open at one end 74 and the projection 10 extends into the end portion 14 through the open end 74 of the end portion.

The intake orifice 42 is disposed in the first chamber 4, the orifice 50 and first check valve 52 are disposed in the wall 30, the end portion orifice 60 and end portion check valve 62 are disposed in the closed end 34 of the end portion 14, and the projection orifice 66 and projection check valve 68 are disposed in the closed end 38 of the projection 10.

Thus, a first compression stage 32 is formed in the first chamber 4 between the piston 16 and the wall 30, a second compression stage 36 is formed in the second chamber 6 between the wall 30 and the closed end 34 of the end portion 14, and a third compression stage 40 is formed in the end portion 14 between the closed end 34 of the end portion 14 and the closed end 38 of the projection 10.

In operation of the embodiments shown in FIGS. 1 and 2, three stages of compression are accomplished by the piston 16 and the end portion 14 driven by the single rod means 8. Referring to FIG. 1, as the rod means 8 is driven to the right, as viewed in the drawings, the gas in the first compression stage 32 and the third compression stage 40 is compressed while gas in the second compression stage 36 is allowed to expand. As the pressure in the first compression stage 32 increases, the compressed gas in the first compression stage 32 is forced through the orifice 50 and first check valve 52 to the second compression stage 36. The end portion check valve 62 remains closed. Gas compressed to the final discharge pressure in the third compression stage 40 is discharged through the projection check valve 68 into the passageway 72 of the projection 10 and out the first end 12 of the housing 2. At the end of the rightward stroke, most of the gas in the first compression stage 32 is transferred into the second compression stage 36 at the first stage pressure. As the rod means 8 moves leftwardly, the first check valve and projection check valve 52, 68 close. The end portion check valve 62 opens to permit flow of gas from the second compression stage 36 to the third compression stage 40, as the pressure in the second stage 36 increases above the pressure in the third stage 40. The first compression stage 32 expands to admit gas through the intake orifice 42, and a conduit and valve combination 76 in the piston 16,in the embodiment shown in FIG. 1, and through the intake orifice 42 and intake valve 44 in the embodiment shown in FIG. 2. At the end of the leftward stroke, the second stage compression is completed, and gas in the second compression stage 36 is transferred through the end portion orifice 60 and end portion check valve 62 into the third compression stage 40. The process is then repeated.

Thus, a given volume of gas enters the first chamber 4 through the combination conduit and valve 76 (FIG. 1), or the intake orifice 42 (FIG. 2) as the piston 16 moves leftwardly, as viewed in the drawings. When the piston 16 moves rightwardly, the gas is compressed. When the pressure in the first compression stage 32 exceeds the pressure in the second compression stage 36, the first check valve 52 opens and the gas passes through the orifice 50 and into the housing second chamber 6. The gas in both the first and second compression stages 32, 36 is compressed as the combined volume continues to decrease as the rod means 8 moves rightwardly. When the rod means 8, and end portion 14, next move leftwardly, the given volume of gas is again compressed in the second compression stage 36, the first check valve 52 having closed. When the pressure in the second compression stage 36 exceeds the pressure in the third compression stage 40, the end portion check valve 62 opens, permitting the gas to flow through the end portion orifice 60 into the third compression stage 40. The gas in both the second and third compression stages 36, 40 is compressed as the rod means 8 continues to move leftwardly. Subsequent rightward movement of the end portion 14 further compresses the gas in the third compression stage 40. Upon the gas reaching a selected pressure in the third compression stage 40, the projection check valve 68 opens, allowing discharge of the compressed gas through the projection orifice 66 and into the passageway 72, which is in communication with a CNG fuel tank (not shown).

Figure 3:
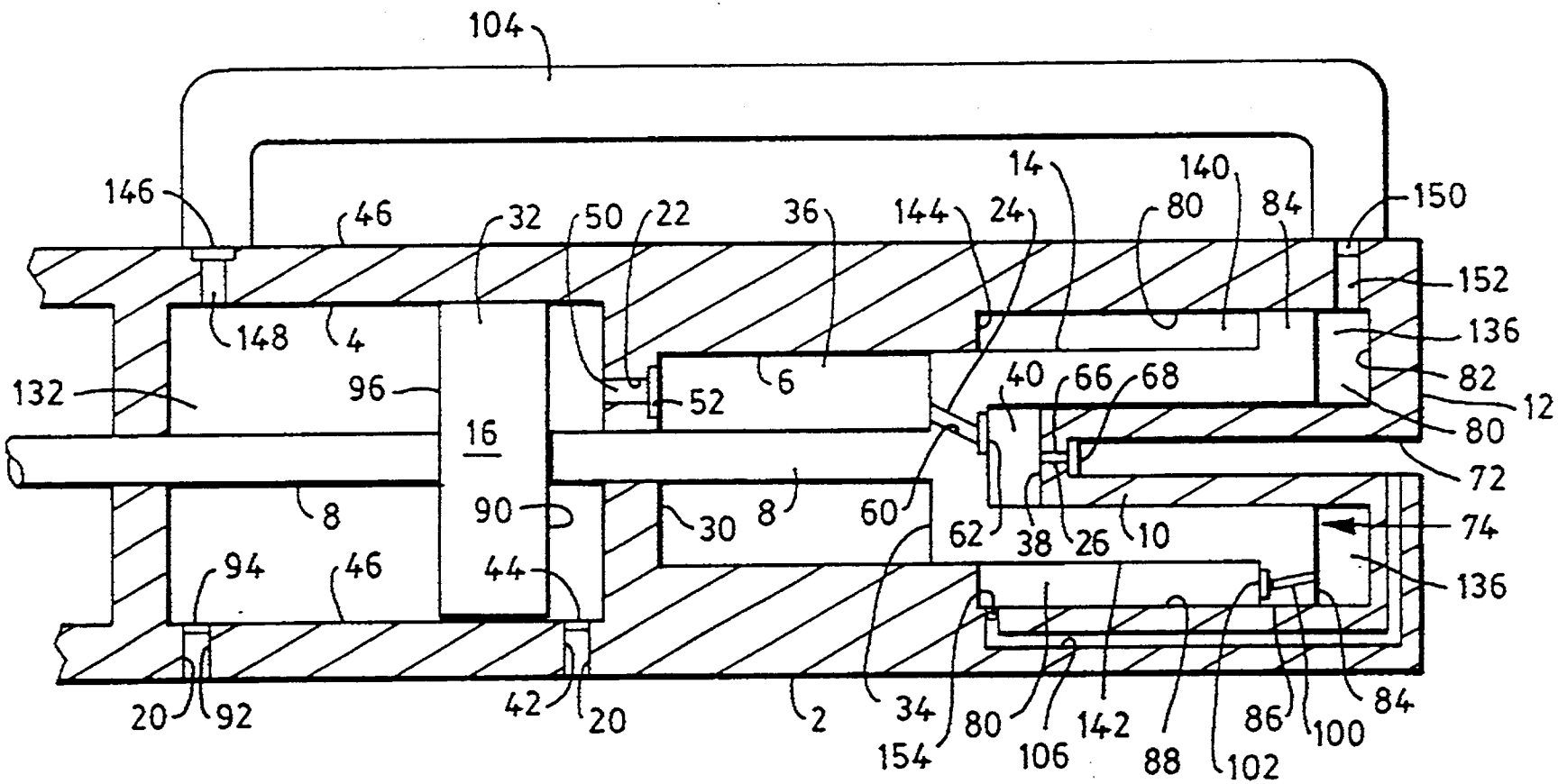
FIG. 3 is a diagrammatic illustration of another alternative embodiment of the inventive compressor.

Referring to FIG. 3, an alternative embodiment of compressor includes the housing 2 having the first and second cylindrical chambers 4, 6 disposed in tandem end-to-end. The second chamber 6 is of lesser inside diameter than the first chamber 4. There is further provided a third cylindrical chamber 80 comprising an extension of the second chamber 6, and having a greater inside diameter than the second chamber 6. The third chamber 80 is provided at an end 82 thereof, which coincides with the housing first end 12, with the inwardly-extending projection 10 having the passageway 72 therein extending from the closed end 38 of the projection 10 to the end 82 of the third chamber 80.

The compressor embodiment shown in FIG. 3 includes the rod 8 extending through the first chamber 4 and into the second chamber 6. The piston 16 is fixed to the rod 8 and is movable in the first chamber 4. The cylindrically-shaped end portion 14 is fixed to the rod 8 and is movable in the second and third chambers 6, 80, the end portion 14 being open at the one end 74. The projection 10 extends into the end portion 14 through the open end 74.

The end portion 14 is provided at its open end 74 with an outwardly extending annular flange 84 which, at the periphery 86 thereof, engages an inside wall 88 of the third chamber 80.

The intake orifice 42 and first intake valve 44 are disposed in the first chamber wall 46 on a first side 90 of the piston 16, and a second intake orifice 92 and second intake valve 94 are disposed in the first chamber wall 46 on a second side 96 of the piston 16. The orifice 50 and first check valve 52 are disposed in the wall 30 separating the first and second chambers 4, 6. The end portion orifice 60 and end portion check valve 62 are disposed in the closed end 34 of the end portion 14. The projection orifice 66 and the projection check valve 68 are disposed in the closed end 38 of the projection 10. The embodiment shown in FIG. 3 is further provided with a flange orifice 100 and a flange check valve 102 disposed in the annular flange 84.

A first transfer conduit 104 extends from the first chamber 4 on the first side 96 of the piston 16 to the third chamber 80 between the annular flange 84 and the end 82 of the third chamber 80. A second transfer conduit 106 extends from the third chamber 80 to the projection passageway 72 proximate the end 82 of the third chamber 80.

Thus, the first first-compression-stage 32 is formed in the first chamber 4 on the second side 90 of the piston 16. The embodiment illustrated in FIG. 3 is a double-acting compressor and is provided with a second first-compression-stage 132 formed in the first chamber 4 on the first side 96 of the piston 16.

As in the previous embodiment, the first second-compression-stage 36 is formed in the second chamber portion 6 between the wall 30 and the closed end 34 of the end portion 14. In the double-acting embodiment shown in FIG. 3, a second second-compression-stage 136 is formed in the third chamber 80 between the annular flange 84 and the end 82 of time third chamber 80.

Similarly to the previous embodiment, the first third-compression-stage 40 is formed in the end portion 14 between the closed end 34 of the end portion 14 and the closed end 38 of the projection 10. In the double-acting embodiment, a second third-compression-stage 140 is formed in the third chamber 80 between a side wall 142 of the end portion 14 and the inside wall 88 of the third chamber 80, and between the annular flange 84 and an annular wall 144 at the juncture of the second and third chambers 6, 80.

A given first quantity of gas passes through the compressor shown in FIG. 3 in much the same manner as described hereinabove with respect to the single-acting compressor shown in FIG. 1 and 2. The double-acting feature of the FIG. 3 embodiment facilitates processing of a second quantity of gas through different channels. For example, while the piston 16 travels rightwardly to compress gas in the compression stage 32, a second quantity of gas is admitted through the second intake orifice 92 and intake valve 94 to the second first-compressions-stage 132. A first transfer check valve 146 is disposed in a first transfer orifice 148 in the wall 46 of the first chamber 4 and remains closed during the admittance of new gas to the second first-compression-stage.

Subsequent leftward movement of the piston 16 compresses the second quantity of gas. When the pressure in the second first-compression-stage 132 exceeds the pressure in the second second-compression-stage 136, the first transfer check valve 146 opens, permitting gas to flow through the transfer orifice 148, the transfer conduit 104, and through a second transfer check valve 150 in a second transfer orifice 152, into the second second-compression-stage 136. The pressure in compression stages 132 and 136 continues to rise as the rod means 8 moves leftwardly. When the rod 8 subsequently moves rightwardly, the end portion flange 84 moves rightwardly, compressing the gas in the second second-compression-stage 136, the second transfer check valve 150 having closed. When the pressure in the second second-compression-stage 136 exceeds the pressure in the second third-compression-stage 140, the gas in the second second-compression-stage 136 forces open the flange check valve 102, permitting gas to flow through the flange orifice 100 in the flange 84 into the second third-compression-stage 140.

Thereafter, leftward movement of the end portion 14 serves to compress the gas in the second third-compression-stage 140 until a selected pressure is reached, at which point a discharge check valve 154 in the second transfer conduit 106 opens, permitting compressed gas to flow from the second third-compression-stage 140, through the second transfer conduit 106, into the projection passageway 72 and out the open end of the projection 10, which is in communication with the aforementioned vehicle CNG fuel tank.

Figure 4:
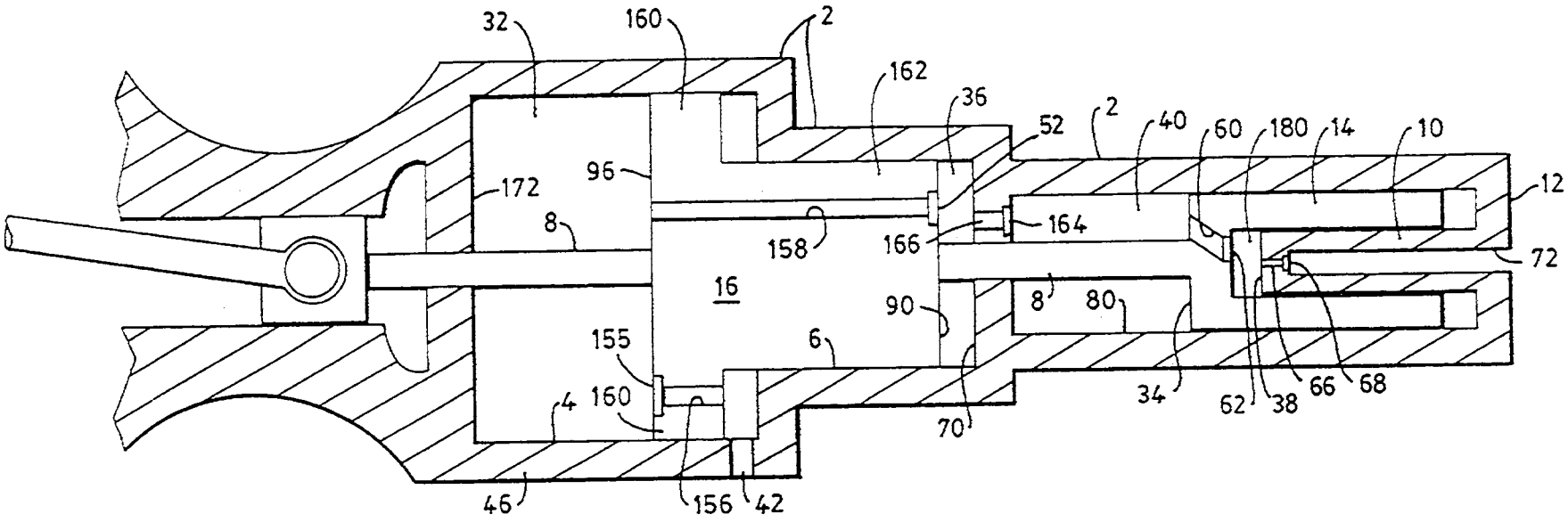
FIG. 4 is a diagrammatic illustration of still another alternative embodiment of the inventive compressor.

Referring to FIG. 4, the alternative embodiment of compressor shown is a four-stage compressor, and includes the housing 2 having therein the first cylindrically-shaped chamber 4 defining the first compression stage 32, the second cylindrically shaped chamber 6 extending axially from the first chamber 4 and having an inside diameter less than the inside diameter of the first chamber 4, the second chamber 6 defining the second compression stage 36, and the cylindrically-shaped third chamber 80 extending axially from the second chamber 6 and having an inside diameter less than the diameter of the second chamber 6, and the cylindrically-shaped tubular projection 10 extending into the third chamber 80.

The rod 8 extends through the first and second chambers 4, 6 and into the third chamber 80. The piston 16 is fixed to the rod 8. In the four-stage embodiment shown in FIG. 4, the piston 16 is provided with a piston first portion 160 reciprocally disposed in the first chamber 4 and a piston second portion 162, of smaller diameter than the piston first portion 160, reciprocally disposed in the second chamber 6. The rod 8 passes through the end 70 of the second chamber 6, which constitutes in this embodiment a wall between the second and third chambers 6, 80.

Referring still to FIG. 4, the open-eluded cylindrically-shaped end portion 14 of the rod 8 is reciprocally disposed in the housing third chamber 80 and around the tubular projection 10.

The gas intake orifice 42 is disposed in the wall 46 of the first chamber 4 and the projection passageway 72 comprises the gas outlet. An intake check valve 155 for the first compression stage 132 is disposed in an intake passage 156 extending through the piston first portion 160. The first check valve 52 is disposed in a second passage 158 extending through the piston first and second portions 160, 162. A second check valve 164 is disposed in an orifice 166 which extends through the second chamber wall 70. The end portion check valve 62 is disposed in the end portion orifice 60 extending through the closed end 34 of the end portion 14. The projection check valve 68 is disposed in the projection orifice 66 in the closed end 38 of the projection 10.

There is thereby provided the first compression stage 32 between the housing second end wall 172 and the first side 96 of the piston first portion 160, the second compression stage 36 between the second side 90 of the piston second portion 162 and the wall 70 between the second and third chambers 6, 80, the third compression stage 40 in the third chamber 80 between the wall 70 and the closed end 34 of the end portion 14, and a fourth compression stage 180 in the end portion 14, between the closed end 34 thereof and the closed end 38 of the projection 10.

A quantity of gas is admitted to the first chamber 4 through the intake orifice 42 and the intake passage 156 and intake passage check valve 155. Leftward movement of the piston 16, as viewed in FIG. 4, closes the intake passage check valve 155, and causes compression of the gas in the first compression stage 32. When the pressure in the first compression stage 32 exceeds the pressure in the second compression stage 36, the first check valve 52 opens, permitting flow of gas through the second passage 158 and into an expanding second compression stage 36 in the second chamber 6. Subsequent rightward movement of the piston 16 compresses the gas in the second compression stage 36, the first check valve 52 having closed. Upon reaching a pressure higher than that in the third compression stage 40, the second check valve 164 in the orifice 166 opens, permitting flow of gas from the second chamber 6 into the third chamber 80 and the third compression stage 40.

Thereafter, as the end portion 14 moves leftwardly, further compression of the gas occurs in the third compression stage 40 until the pressure of the gas opens the end portion check valve 62 to permit flow into the end portion 14. Subsequent rightward movement of the end portion 14 still further compresses the gas in the fourth compression stage 180. Upon the fourth compression stage 180 reaching a discharge pressure, the projection check valve 68 opens, facilitating flow from the fourth compression stage 180, through the projection passageway 72 to the CNG tank undergoing refueling.

There is thus provided a relatively simple, reliable and inexpensive high pressure gas compressor having only one piston rod and a plurality of compression chambers formed in a single housing.

It is understood that the present invention is by no means limited to the particular constructions herein disclosed and/or shown in the drawings, but also comprises any modifications or equivalents within the scope of the claims.

Having thus described my invention, what I claim as new and desire to secure by Letters Patent of the United States is:

1. A gas compressor comprising:

a housing defining adjacent first and second cylindrical chambers in axial alignment, time second of said chambers having a smaller inside diameter than the first of said chambers;

rod means extending through said first chamber and into said second chamber;

a tubular projection extending from a first end of said housing into said second chamber;

a cylindrically-shaped end portion fixed to said rod means, said end portion being disposed slidably upon said projection and within said second chamber;

a piston fixed to said rod means and slidably disposed within said first chamber; and conduit means for admitting gas to said first chamber, transferring gas from said first chamber to said second chamber and from said second chamber to the interior of said end portion, and discharging compressed gas from said end portion, through said projection.

2. The compressor in accordance with claim 1 wherein said housing defines said first and second chambers and a third chamber aligned therewith, and said piston is stepped to provide a first piston portion disposed in said first chamber and a second piston portion disposed in said second chamber, said piston second portion being of lesser diameter than said piston first portion.

3. The compressor in accordance with claim 2 wherein said piston first portion and said housing second end define therebetween a first compression stage in said first chamber.

4. The compressor in accordance with claim 3 wherein said piston second portion and a wall between said second and third chamber defines therebetween a second compression stage in said second chamber.

5. The compressor in accordance with claim 4 wherein said wall between said second and third chambers and a closed end of said end portion define in said third chamber a third compression stage.

6. The compressor in accordance with claim 5 wherein said closed end of said end portion and a closed end of said projection define in said end portion a fourth compression stage.

7. The compressor in accordance with claim 6 wherein said conduit means for admitting gas to said first chamber comprises an intake orifice in a wall of said first chamber, an intake passage extending through said first piston portion, and an intake passage check valve disposed in said intake passage.

8. The compressor in accordance with claim 7 further comprising a second passage extending through said piston first and second portions for interconnecting said first and second compression stages, and a first check valve disposed in said second passage.

9. The compressor in accordance with claim 8 wherein said conduit means for transferring gas from said second chamber to said third chamber comprises an orifice in said wall between said second and third chambers and a second check valve disposed in said orifice between said second and third chambers.

10. The compressor in accordance with claim 9 wherein said conduit means for transferring gas from said third chamber to the interior of said end portion comprises an end portion orifice extending through said closed end of said end portion and an end portion check valve in said end portion orifice.

11. The compressor in accordance with claim 10 wherein said conduit means for discharging compressed gas from said end portion comprises a projection orifice and a projection check valve disposed in said projection orifice.

12. The compressor in accordance with claim 1 wherein said piston and a wall separating said first chamber from said second chamber define a first compression stage in said first chamber, said wall and a closed end of said end portion define a second compression stage in said second chamber, and said closed end of said end portion and a closed end of said projection define a third compression stage.

13. The compressor in accordance with claim 12 wherein said conduit means for admitting gas to said first chamber comprises an intake orifice in a wall of said first chamber proximate said wall separating said first chamber from said second chamber, and an intake valve disposed in said intake orifice.

14. The compressor in accordance with claim 13 wherein said conduit means for transferring gas from said first chamber to said second chamber comprises an orifice ill said wall separating said first chamber from said second chamber, and a first check valve disposed in said orifice in said wall separating said first chamber from said second chamber.

15. The compressor in accordance with claim 14 wherein said conduit means for transferring gas from said second chamber to the interior of said end portion comprises an end portion orifice in said closed end of said end portion, and an end portion check valve disposed in said end portion orifice.

16. The compressor in accordance with claim 15 wherein said conduit means for discharging gas from said end portion through said projection comprises a projection orifice in said closed end of said projection, and a projection check valve disposed in said projection orifice, and said projection being open to said end of said housing.

17. The compressor in accordance with claim 16 wherein said piston and a second end of said housing define a second first-compression-stage in said first chamber.

18. The compressor in accordance with claim 17 wherein said second chamber is stepped to provide a second chamber first portion adjacent said first chamber, and a second chamber second portion of larger inside diameter than said second chamber first portion and adjacent said housing first end.

19. The compressor in accordance with claim 18 wherein said end portion at said open end thereof is provided with an outwardly extending annular flange, an edge of said flange in slidable engagement with an inside wall of said second chamber second portion, said flange and said housing first end wall defining a second second compression stage.

20. The compressor in accordance with claim 19 wherein said end portion flange and an annular wall dividing said second chamber into said first and second portions define a second third-compression-stage in said second chamber second portion.

21. The compressor in accordance with claim 20 wherein said conduit means for admitting gas to said first chamber further comprises a second intake valve in a second intake orifice in said wall of said first chamber proximate said second end wall of said housing.

22. The compressor in accordance with claim 21 wherein said conduit means for transferring gas from said first chamber to said second chamber further comprises a transfer conduit external of said housing interconnecting said second first compression stage and said second second compression stage.

23. The compressor in accordance with claim 22 further including conduit means for transferring gas from said second second compression stage to said second third compression stage, comprising a flange check valve disposed in a flange orifice extending through said annular flange.

24. The compressor in accordance with claim 23 further comprising a conduit extending from said second third-compression-stage proximate said wall dividing said second chamber to the interior of said tubular projection for discharging gas from said compressor.

25. A gas compressor comprising:

a housing having a first cylindrical chamber and a second cylindrical chamber, said first and second cylindrical chambers being disposed in tandem end-to-end, said second chamber being of lesser inside diameter than said first chamber, said second chamber having at an end thereof an inwardly-extending projection having a passageway therein extending from a closed end of said projection to said end of said second chamber;

rod means extending through said first chamber and into said second chamber;

a piston fixed to said rod means and movable in said first chamber;

a cylindrically-shaped end portion fixed to said rod means and movable in said second chamber, said cylindrically-shaped end portion being open at one end, said projection extending into said end portion; gas intake means disposed in said first chamber;

an orifice and a first check valve disposed in a wall separating said first chamber and said second chamber;

an orifice and a second check valve disposed in a closed end of said end portion; and an orifice and a third check valve disposed in said closed end of said projection; such that a first compression stage is formed in said first chamber between said piston and said wall;

a second compression stage is formed in said second chamber between said wall and said closed end of said end portion; and a third compression stage is formed in said end portion between said closed end of said end portion and said projection closed end.

26. A gas compressor comprising:

a housing having a first cylindrical chamber, a second cylindrical chamber, said first and second chambers being disposed in tandem end-to-end, said second chamber being of lesser inside diameter than said first chamber, and a third cylindrical chamber comprising an extension of said second chamber, said third chamber having a greater inside diameter than said second chamber, said third chamber having at an end thereof an inwardly-extending projection having a passageway therein extending from a closed end of said projection to said end of said third chamber;

a rod extending through said first chamber and into said second chamber;

a piston fixed to said rod and movable in said first chamber;

a cylindrically-shaped end portion fixed to said rod and movable in said second and third chambers, said end portion being open at one end, said projection extending into said end portion, said end portion having at its open end an outwardly extending annular flange which, at the periphery thereof, engages an inside wall of said third chamber;

a first intake orifice and a first intake valve disposed in said first chamber on a second side of said piston;

a second intake orifice and a second intake valve disposed in said first chamber on a first side of said piston;

an orifice and a first check valve disposed in a wall separating said first chamber and said second chamber;

an orifice and a second check valve disposed in a closed end of said end portion;

an orifice and a third check valve disposed in said closed end of said projection;

a flange orifice and a flange check valve disposed in said annular flange;

a first transfer conduit extending from said first chamber on said first side of said piston to said third chamber between said annular flange and said end of said third chamber; and a second transfer conduit extending from said third chamber to said projection passageway proximate said end of said third chamber; such that a first first-compression-stage is formed in said first chamber on said second side of said piston;

a second first-compression-stage is formed in said first chamber on said first side of said piston;

a first second-compression-stage is formed in said second chamber between said wall and said closed end of said end portion;

a second second-compression-stage is formed in said third chamber between said annular flange and said end of said third chamber;

a first third-compression-stage is formed in said end portion between said closed end of said end portion and said closed end of said projection; and a second third-compression-stage is formed in said third chamber between a side wall of said end portion and said inside wall of said third chamber, and between said annular flange and an annular wall at the juncture of said second and third chambers.

27. A gas compressor comprising:

a housing having therein a first cylindrically-shaped chamber defining a first compression stage, a second cylindrically-shaped chamber extending axially from said first chamber and having an inside diameter less than the inside diameter of said first chamber, said second chamber defining a second compression stage, and a cylindrically-shaped third chamber extending axially from said second chamber and having an inside diameter less than said inside diameter of said second chamber, and a cylindrically-shaped projection extending into said third chamber;

a rod extending through said first and second chambers and into said third chamber;

a piston having a piston first portion reciprocally disposed in said first chamber and a piston second portion of smaller diameter than said piston first portion reciprocally disposed in said second chamber, said rod passing through a wall between said second and third housing chambers;

an open-ended cylindrically-shaped end portion of said rod reciprocally disposed in said housing third chamber and around said projection;

a gas inlet orifice disposed in a wall of said housing first chamber and a gas outlet extending through said projection;

a first check valve disposed in a first passage in said piston first portion, a second check valve disposed in a second passage extending through said piston first and second portions, a third conduit check valve disposed in a conduit through said wall, an end portion check valve disposed in a conduit extending through a closed end of said end portion remote from an open end thereof, and a projection check valve disposed in a projection conduit in a closed end of said projection remote from a housing first end;

whereby to provide said first compression stage between a second end wall of said housing and a surface of said piston first portion, said second compression stage between an end wall of said piston second portion and said wall between said second and third chambers, a third compression stage in said third chamber between said wall and said end of said end portion, and a fourth compression stage in said end portion between said closed end thereof and said closed end of said projection.

* * * * *